US006344620B1

(12) United States Patent
Nakamura

(10) Patent No.: US 6,344,620 B1
(45) Date of Patent: Feb. 5, 2002

(54) MULTIDIRECTIONAL INPUT DEVICE

(75) Inventor: Masahiko Nakamura, Yao (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 09/806,517

(22) PCT Filed: Aug. 10, 2000

(86) PCT No.: PCT/JP00/05360

§ 371 Date: Apr. 17, 2001

§ 102(e) Date: Apr. 17, 2001

(87) PCT Pub. No.: WO01/20629

PCT Pub. Date: Mar. 22, 2001

(30) Foreign Application Priority Data

Sep. 14, 1999 (JP) ..... 11-260713

(51) Int. Cl.[7] ..... H01H 25/06; H01C 10/16

(52) U.S. Cl. ..... 200/6 A; 200/4; 338/128

(58) Field of Search ..... 200/4, 5 R, 6 A, 200/17 R, 18, 335, 339; 338/128–131; 345/157, 161; 463/36–38

(56) References Cited

U.S. PATENT DOCUMENTS 3,784,746 A * 1/1974 Hess ..... 179/1 GQ
4,587,510 A * 5/1986 Kim ..... 338/128
6,002,351 A * 12/1999 Takeda et al. ..... 341/20
6,078,247 A * 6/2000 Shimomura ..... 338/131
6,275,139 B1 * 8/2001 Shimomura et al. ..... 338/128

* cited by examiner

*Primary Examiner*—Michael Friedhofer
(74) *Attorney, Agent, or Firm*—Armstrong, Westerman, Hattori, McLeland & Naughton, LLP

(57) ABSTRACT

A multidirectional input device with a built-in push-down switch, capable of reducing the number of parts, eliminating soldering for connection with a mounting substrate, and reducing an assembly cost of devices using the multidirectional input device, wherein a key top (70) provided under an operating member (30) operating a set of upper and lower rotating members (40*a*) and (40*b*) is installed through the bottom plate part (11) of a case (10) and pushed down by the operating member (30), and a switch main body (110) operated by the key top (70) and provided on a substrate (100), on which the case (10) is installed, comprises a fixed contact formed on the substrate (100) and a dome-shaped moving contact covering the fixed contact and fixed onto the substrate.

4 Claims, 7 Drawing Sheets

A – A

A – A

8 - 8

C – C

MULTIDIRECTIONAL INPUT DEVICE

FIELD OF THE INVENTION

The present invention relates to a multi-directional input apparatus for inputting various signals by operating an operating member which is operated in arbitrary circumferential direction.

BACKGROUND ART

A multi-directional input apparatus of this type called joystick comprises a case secured on a board, a set of upper and lower turning members having long holes each extending in a direction perpendicular to the turning direction, an operating member passing through the long holes of the set of upper and lower turning members for turning the turning members by operating the operating member in an arbitrary circumferential direction, a spring compressed and accommodated in the case for resiliently holding the operating member in its neutral position, and a set of signal output means for outputting a signal corresponding to the turning angle of each the turning member.

As the set of signal output means, a volume such as an electric sensor, a magnetic sensor, optical sensor or the like is used, and the volume is relatively commonly used in terms of costs and the like. Multi-directional input apparatuses using the volume as the set of signal output means are described in Japanese Patent Application Laid-open No. S61-198286, Japanese Utility Model Publication No. H6-43963, and Japanese Utility Model Publication No. H7-27608.

Some of this kind of multi-directional input apparatuses have operating members which can vertically move, and the pushdown switches are operated by pushing down operation of the operating members. The multi-directional input apparatus having such a pushdown switch is described in Japanese Patent Application Laid-open No. H10-283885. In the multi-directional input apparatus having the pushdown switch described in Japanese Patent Application Laid-open No. H10-283885, the pushdown switch comprises a pushdown member provided below the operating member, ad a switch body provided below the pushdown member on a bottom plate of a case.

In the multi-directional input apparatus having the pushdown switch described in Japanese Patent Application Laid-open No. H10-283885, however, the pushdown switch is accommodated in the case including the switch body. Therefore, when the multi-directional input apparatus is mounted, it is necessary to solder the switch body in the apparatus to a print circuit on the board.

Further, in a general multi-directional input apparatus having the pushdown switch, a normal pushdown switch unit is used as the pushdown switch. The normal pushdown switch unit comprises six members, i.e., a frame, a body, a terminal, a key top, a snap plate and a cover. Therefore, the pushdown switch becomes expensive, and this increases the manufacturing cost of the multi-directional input apparatus.

Further, the volume used as the one set of signal output means has the following problems.

That is, although the volume is inexpensive as compared with other signal output means, the volume requires a large number of parts (usually five parts), a rate of cost occupied by the volume in the multi-directional input apparatus is still high. Further, since it is necessary to use solder between the multi-directional input apparatus and a board onto which the multi-directional input apparatus is mounted, this increases the manufacturing cost of equipment which uses the multi-directional input apparatus.

The present invention has been accomplished in view of these circumstances, and it is a first object of the present invention to provide a multi-directional input apparatus in which although the pushdown switch is provided, the switch can easily be mounted to the board without soldering.

It is a second object of the invention to provide a multi-directional input apparatus having a small number of parts constituting the pushdown switch.

It is a third object of the invention to provide a multi-directional input apparatus in which the number of parts of signal output means is small, and it is unnecessary to solder the signal output means to the board.

DISCLOSURE OF THE INVENTION

To achieve the above object, the present invention provides a multi-directional input apparatus comprising a case secured on a board; a set of upper and lower turning members supported in the case such that the turning members can turn into two intersecting directions and each having a long hole extending in a direction perpendicular to the turning direction; an operating member which can be pushed down and which passes through each of the long holes of the set of upper and lower turning members, the operating member turning each of the turning members when the operating member is operated in arbitrary direction therearound; a holding mechanism for resiliently holding the operating member and/or the turning members at a neutral position; a set of signal output means for outputting signal corresponding to a turning angle of each of the turning members; and a pushdown switch which is switched when the operating member is pushed down; wherein the pushdown switch comprises a combination of a key top which is vertically movably provided below the operating member such as to pass through a bottom plate of the case, and a switch body which is located below the key top and mounted on the board, and which is operated when the operating member is pushed down and the key top is moved down.

In such a multi-directional input apparatus, the operating member passes through the bottom plate of the case, if the operating member is pushed down, the key top is moved down, thereby operating the switch body on the board. Therefore, when the multi-directional input apparatus is mounted, it is unnecessary to solder the switch to the board.

In the other multi-directional input apparatus of the invention, the switch body comprises a combination of a stationary contact formed on the board and a domical movable contact piece which can be resiliently deformed and secured on the stationary contact. With this structure, the number of parts constituting the switch body can largely be reduced.

According to another multi-directional input apparatus of the invention, the movable contact piece is secured on the stationary contact by pasting a resin sheet on the board from above the movable contact piece. With this structure, it is easy to assemble the switch body on the board.

According to another multi-directional input apparatus of the invention, the signal output means is constituted such that gears are mounted to one ends of the set of upper and lower turning members, straight-ahead sliders capable of moving along two side surfaces of the case and the board are mounted below the gears, teeth meshing with the gears are provided on upper surfaces of the straight-ahead sliders, and the contacts which can slide to come into contact with resistance circuits to constitute volumes together with the resistance circuits are mounted on lower surfaces of the straight-ahead sliders.

With this structure, when the operating member is operated and the turning members are turned, the gears provided on the one ends of the turning members are rotated. With the rotation, the straight-ahead sliders are moved and the contacts slide on the resistance circuits formed on the surface of the board, and the function as a volume can be obtained.

Since the resistance circuits are provided on the side of the board, the number of signal output means is also reduced, and it is unnecessary to solder the resistance circuit to the board. Especially, the accommodating portion for accommodating the straight-ahead slider can be integrally formed on the case. The gear can also be integrally formed on the case. By forming these members integrally into the multi-directional input apparatus, the number of parts constituting the volume can be reduced into two, i.e., the straight-ahead slider and the contact.

The accommodating portion for accommodating the straight-ahead slider may be separately mounted to the case, but it is preferable to integrally form the accommodating portion on the side surface of the case to reduce the number of parts.

A fan-like member having an arc surface formed with teeth is preferable as the gear because the apparatus can be made small. It is preferable that it is integrally formed on the end of the turning member because the number of parts is reduced.

The basic structure of the multi-directional input apparatus is not limited. For example, the holding mechanism for resiliently holding the operating member at the neutral position may directly hold the operating member at the neutral position, or may indirectly hold the set of upper and lower operating members at the neutral position using spring, or may directly hold both the operating members at the neutral position. The spring may be disposed on either upper or lower one of the sets of the upper and lower turning members.

Preferable signal output means is a slide type volume-integral means employed for the multi-directional input apparatus according to claim 4 because the number of parts can be reduced, and the assembling operation is simplified. A signal output means having a general variable resistance unit may be used, and other means such as a magnetic type means or optical type means may also be used of course.

EXPLANATION OF SYMBOLS

| | |
|---|---|
| 10 | case |
| 10a | lower case |
| 10b | upper case |
| 15 | body |
| 16 | slider accommodating portion |
| 20A, 20B | volume section (signal output means) |
| 30 | operating member |
| 40A, 40B | turning member |
| 41A, 41B | turning shaft |
| 42A | semi-spherical portion |
| 43A, 43B | long hole |
| 44A, 44B | gear |
| 45A, 45B | teeth |
| 50 | hoisting and lowering slider |
| 60 | spring |
| 70 | key top constituting pushdown switch |
| 80 | straight-ahead slider |
| 82 | teeth |
| 90 | contact |
| 100 | board |
| 110 | switch body of pushdown switch |
| 111 | stationary contact |
| 112 | movable contact piece |
| 120 | resistance circuit |

EMBODIMENT OF THE INVENTION

Figure 1:
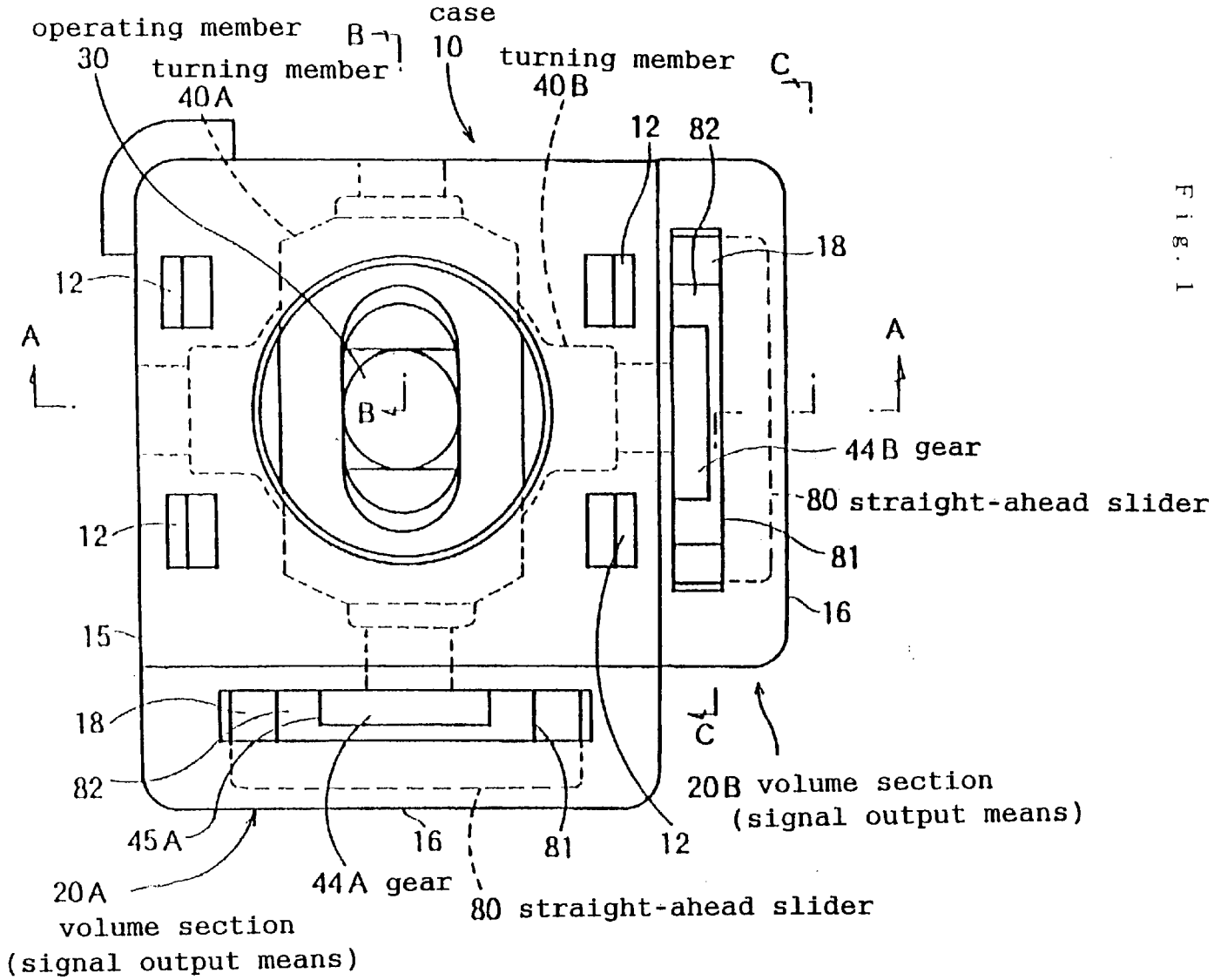
FIG. 1 is a plan view of a multi-directional input apparatus according to an embodiment of the present invention.

An embodiment of the present invention will be explained based on the drawings below. As shown in FIG. 1, in a multi-directional input apparatus of a first embodiment of the invention, a case 10 is secured on a board 100 (see FIG. 6), and the case 10 is integrally provided at its two side with a set of volume sections 20A and 20B as signal output means.

Figure 2:
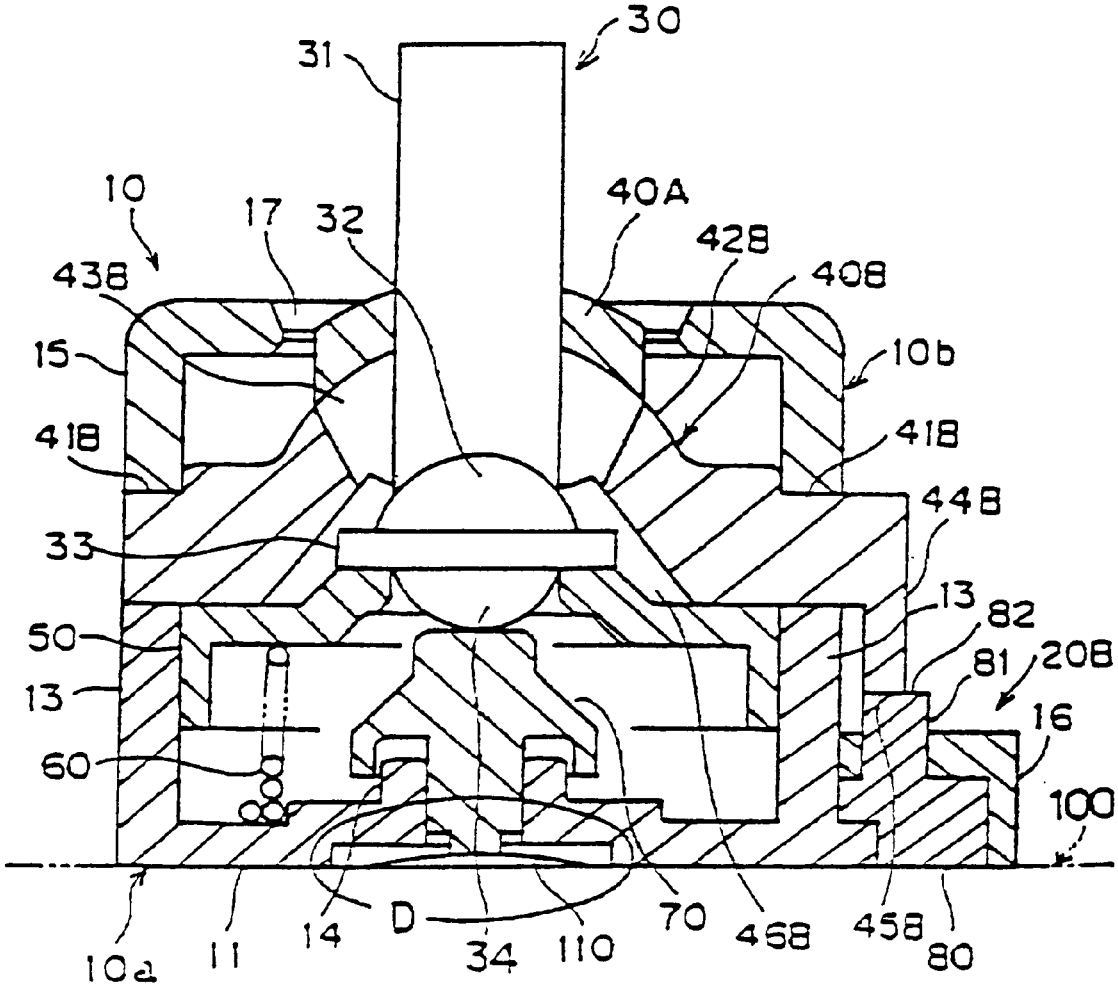
FIG. 2 is a sectional view taken along a narrow A—A in FIG. 1.
Figure 3:
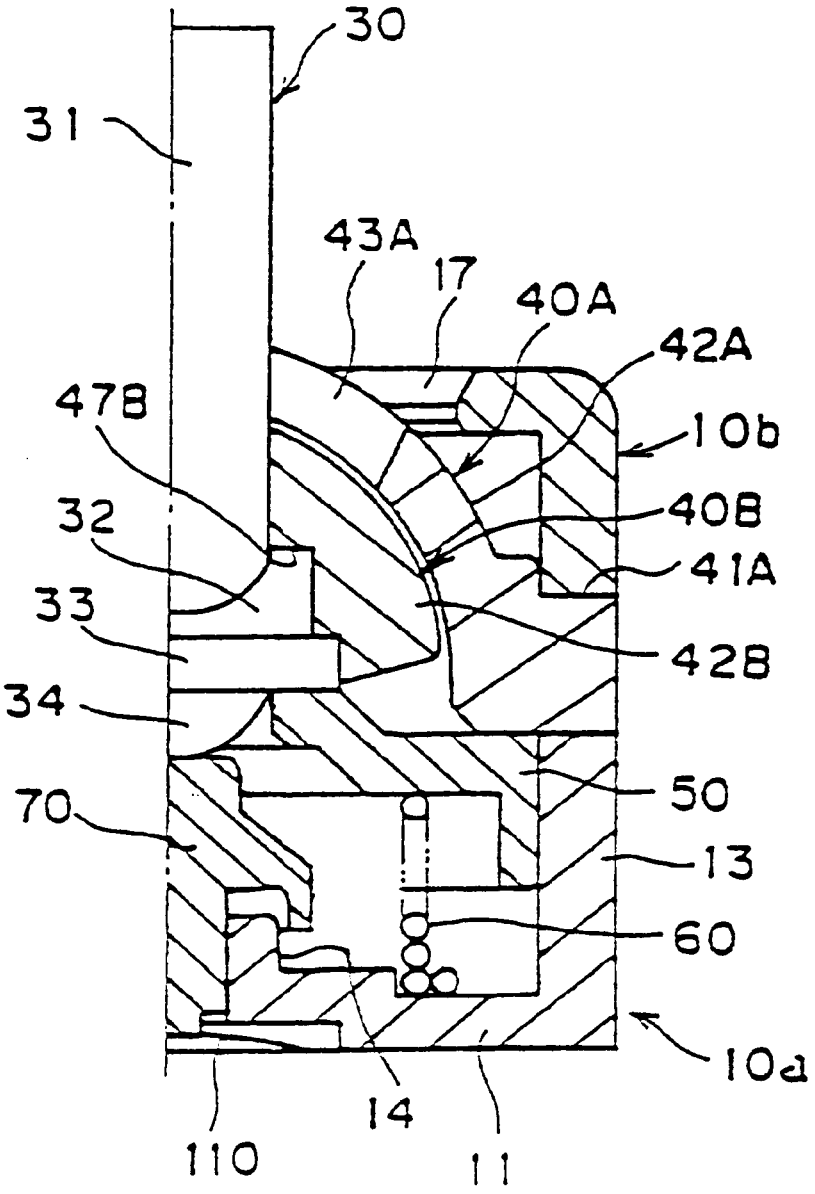
FIG. 3 is a sectional view taken along a narrow B—B in FIG. 1.
Figure 4:
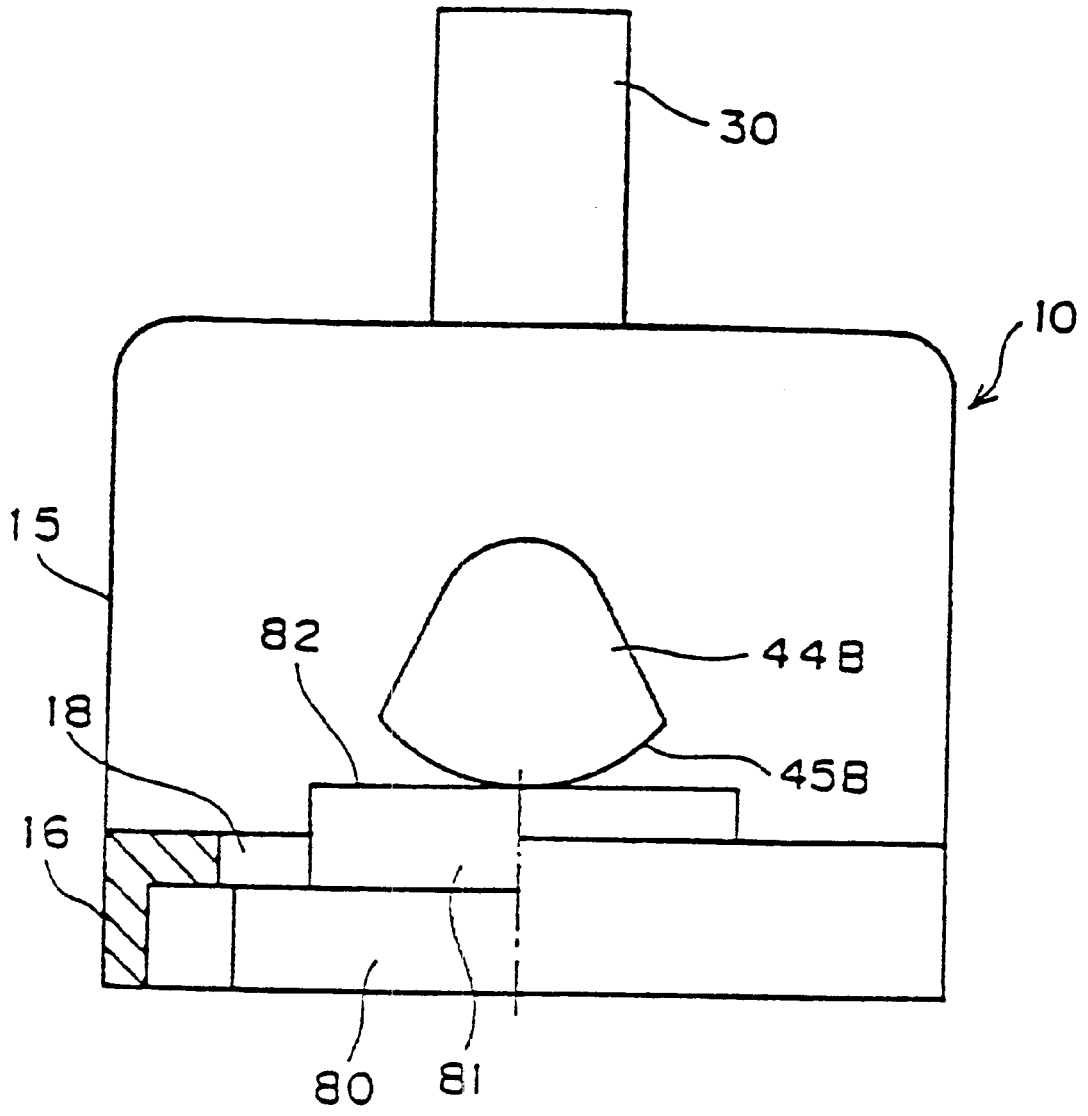
FIG. 4 is a sectional view taken along an arrow C—C in FIG. 1.

As shown in FIGS. 2 and 3, accommodated in a body of the case 10 excluding the volume sections 20A and 20B are a rod-like operating member 30 inclingly operated in arbitrary circumferential direction around its lower portion, a set of upper and lower turning members 40A and 40B, a hoisting and lowering slider 50 and a spring 60 for resiliently holding the operating member 30 at its neutral position, and a key top 70 which is pushed down by the operating member 30.

The key top 70 constitute a pushdown switch together with a switch body 110 on the board 100. Straight-ahead sliders 80 and 80 are provided in volume sections 20A and 20B.

The box-like case 10 secured on the board 100 is of a two-piece structure comprising a lower case 10*a* forming a bottom plate of the case 10 and an upper case 10*b* placed on the lower case 10*a* from above.

The lower case 10*a* has a substantially quadrangle bottom plate 11. The bottom plate 11 is provided at its four corners with pawls 12 which are upwardly projecting for securing the uppercase 10*b* to the bottom plate 11. A support 13 is projected from a central portion of sides of the bottom plate 11 for supporting the turning members 40A and 40B. The bottom plate 11 is provided at its central portion with a cylindrical guide 14 for vertically guiding a key top 70.

The upper case 10*b* includes a box-like body 15 which is to be put on the lower case 10*a* and whose bottom is opened. The upper case 10*b* also includes slider accommodating portions 16 and 16. The body 15 is provided at its ceiling with and opening 17 through which the operating member 30 projects. A plurality of openings into which pawls 12 of the lower case 10*a* are formed around the opening 17. The body 15 is provided at its side walls with notches into which the support 13 of the lower case 10*a* is fitted.

As shown in FIGS. 1, 2, 4 and 5, each of the slider accommodating portions 16 and 16 accommodating the straight-ahead slider 80 is a regular hexahedronal box expanded from the lower side surface sideway, and a lower surface of the slider accommodating portion 16 is entirely opened. Each of the slider accommodating portions 16 and 16 is provided at its upper surface with a slit-like opening 18 along a side surface of the body 15.

When the upper case 10*b* is put on the lower case 10*a,* the pawls 12 of the lower case 10*a* engage an opening if the body 15 of the upper case 10*b* so that the lower case 10*a* and the upper case 10*b* are secured to each other. When the support 13 of the lower case la is fitted to the notches of the body 15 of the uppercase 10*b,* each of the side surfaces of the body 15 is formed with a circle opening for supporting opposite end shafts of the turning members 40A and 40B.

As shown in FIGS. 2 and 3, the operating member 30 includes a rod 31 having a circular cross section, a turning shaft 32 continuously formed on a lower portion of the rod 31, a large-diameter disc 33 continuously formed on a further lower portion of the turning shaft 32, and a downwardly swelling semi-circular projection 34 formed on a central portion of a lower surface of the disc 33. The disc 33 has an upwardly swelling semi-circular cross section, and is projecting in two directions perpendicular to the turning shaft 32. An axial center of the turning shaft 32 crosses the center of the downwardly swelling semi-circular projection 34.

The upper turning member 40A has turning shafts 41A and 41A, and an upwardly swelling arc 43A. The arc 43A is provided with a long hole 43A extending toward the turning center axis. The long hole 43A functions as a guide hole for the operating member 30. A gear 44A is integrally formed on a tip end surface of one of the turning shafts 41A and 41A. The gear 44A projects sideway of the body 15, and is located above the opening 18 of one of the slider accommodating portions 16 and 16. The gear 44A has a fan-like shape whose arc surface is directed downward, and the arc surface is formed with spur wheel teeth 45A.

The lower turning member 40B is combined with below the upper turning member 40A perpendicularly. The turning member 40B is provided at its opposite ends with turning shafts 41B and 41B each having a circular cross section. The turning member 40B is provided with an upwardly swelling semi-spherical portion 42B formed between the turning shafts 41B and 41B. The semi-spherical portion 42B is provided with a long hole 43B extending toward the turning center axis. The long hole 43A functions as a guide hole for the operating member 30.

The semi-spherical portion 42B is provided at its lower surface with a recess 46B into which the disc 33 of the operating member 30 is fitted. The recess 46B ensures the turning movement of the disc 33 when the operating member 30 is operated toward the long hole 43B of the turning member 40B. A pair of recessed bearings 47B and 47B are provided in an inner surface of the recess 46B such as to sandwich the long hole 43B. The turning shaft 32 of the operating member 30 is fitted to the bearings 47B and 47B.

A gear 44B is integrally formed on a tip end surface of one of the turning shafts 41B and 41B. The gear 44B projects sideway of the body 15, and is located above the other one of the slider accommodating portions 16 and 16. The gear 44B has a fan-like shape whose arc surface is directed downward, and the arc surface is formed with spur wheel teeth 45B.

The hoisting and lowering slider 50 for resiliently holding the operating member 30 at the neutral position is annular in shape so that the hoisting and lowering slider 50 can vertically movably fitted in the body 15 of the case 10. The hoisting and lowering slider 50 is disposed below the turning members 40A and 40B, and is biased upward by the spring 60 compressed and accommodated between the hoisting and lowering slider 50 and the bottom plate 11 of the case 10.

The hoisting and lowering slider 50 is biased and resiliently brought into contact with flat a lower surface of the disc 33 of the operating member 30 and flat surfaces formed on the lower surfaces of the turning members 40A and 40B, thereby directly holding the operating member 30 and the turning members 40A and 40B at the neutral position.

The key top 70 vertically moved by the operating member 30 is inserted into the cylindrical guide 14 formed at the central portion of the bottom plate 11 of the case 10 such as to pass through the bottom plate 11. With this, a lower end of the key top 70 abuts against the switch body 110 on the board 100 from above, and the switch body 110 resiliently pushes the upper operating member 30 upward through the key top 70.

Figure 7:
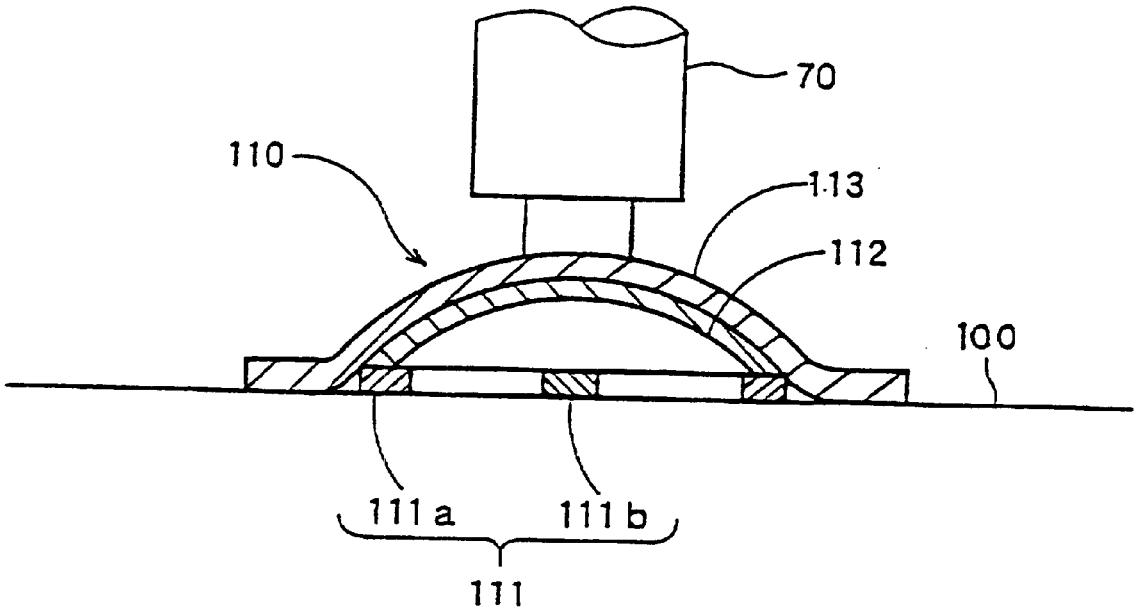
FIG. 7 is an enlarged view of a portion D in FIG. 2.

As shown in FIG. 7, the switch body 110 constituting the pushdown switch together with the key top 70 comprises a stationary contact 111 formed on the board 100 by printing, and a domical movable contact piece 112 secured on the stationary contact 111. The stationary contact 111 comprises an annular first contact 111*a* and a second contact 111*b* formed inside of the first contact 111*a*. The movable contact piece 112 is made of conductive thin plate, and is secured on the annular first contact 111*a* by pasting a resin sheet 113 on the board 100 from above the movable contact piece.

The straight-ahead sliders 80 and 80 accommodated in the slider accommodating portions 16 and 16 of the case 10 are capable of moving horizontally along a side surface of the body 15, and the straight-ahead sliders 80 and 80 are prevented from being pulled out downward by means of the side edge of the bottom plate 11 of the lower case 10*a*. Each of the straight-ahead sliders 80 and 80 is provided at its upper portion with a projection 81 projecting upward of the slider accommodating portion 16 through the slit-like opening 18 formed in the upper surface of the slider accommodating portions 16 and 16. The projection 81 is formed at its upper surface with rack gear teeth 82 in the moving direction of the straight-ahead slider 80. The teeth 82 meshes with the teeth 45A and 45B of the fan-like gears 44A and 44B formed on one ends of the turning members 40A and 40B.

Figure 5:
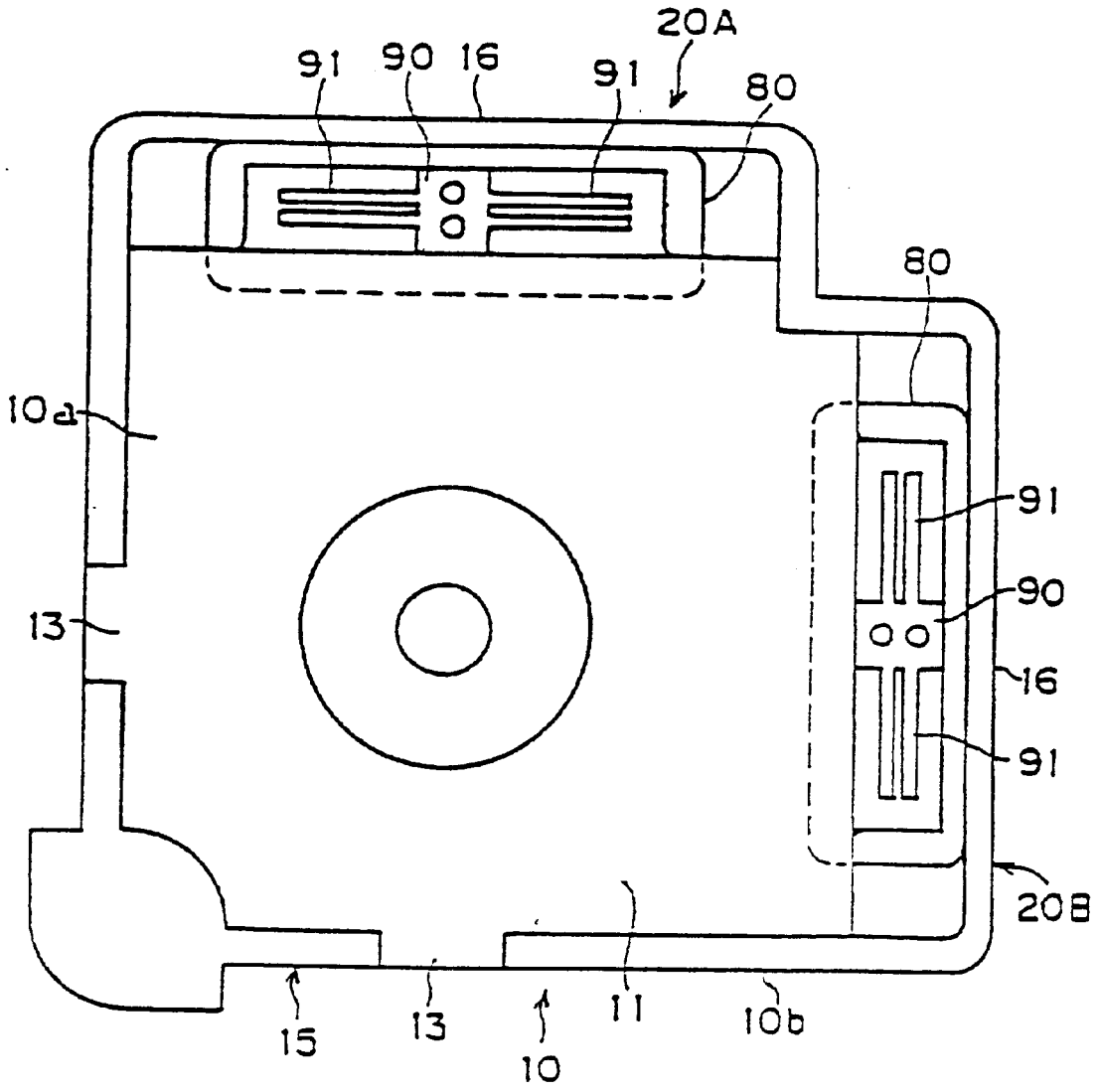
FIG. 5 is a bottom view of the multi-directional input apparatus.

As shown in FIG. 5, a contact 90 is mounted to a lower surface of each of the straight-ahead sliders 80 and 80. The contact 90 faces a surface of the board 100 through the opening formed in the lower surface of the slider accommodating portion 16, and is resiliently contacted with a resistance circuit 120 (see FIG. 6) formed on the surface of the mounting board 100.

Figure 6:
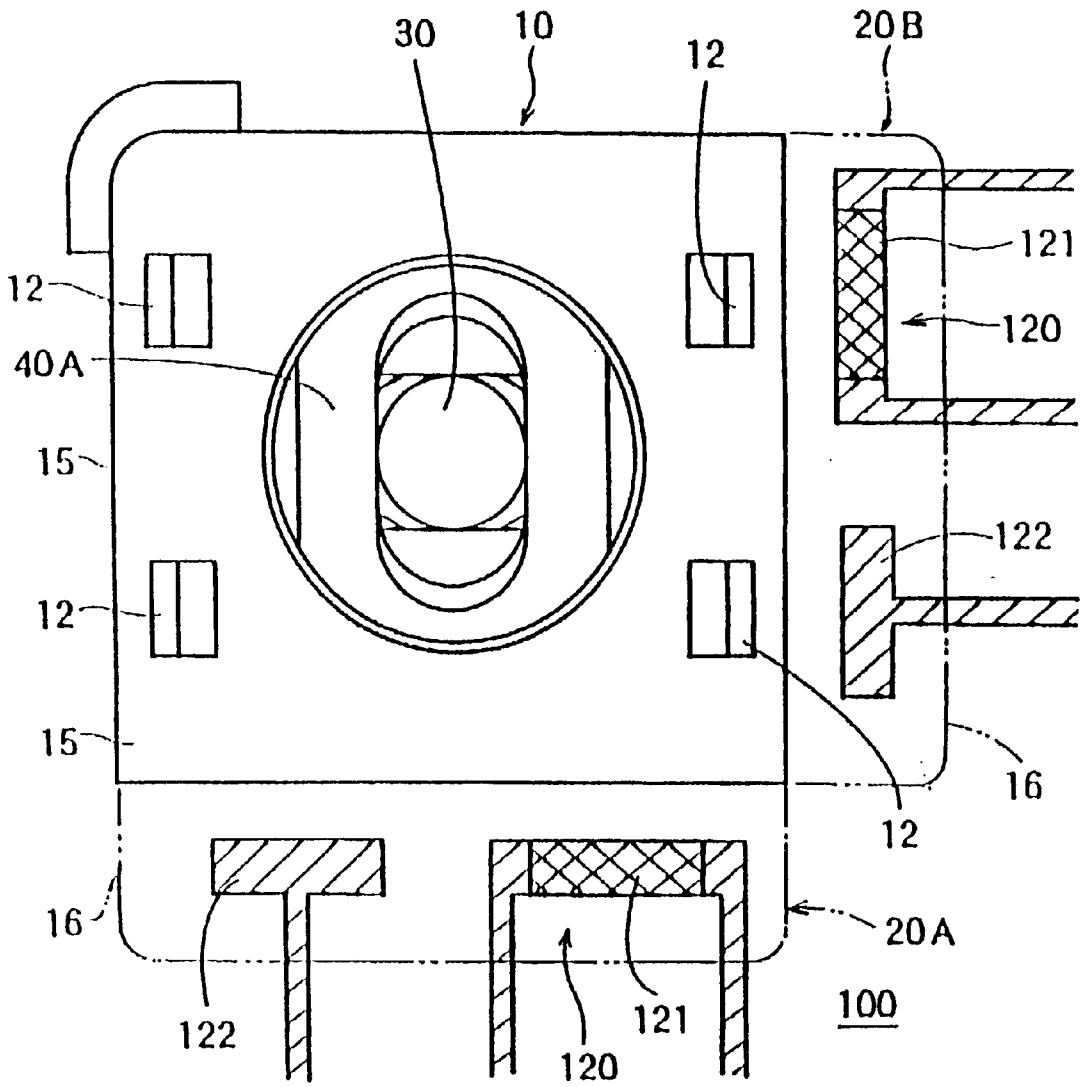
FIG. 6 is a pattern circuit diagram of a resistant circuit combined with the multi-directional input apparatus.

As shown in FIG. 6, the resistance circuits 120 are located below volume portions 20A and 20B, and formed on the surface of the mounting board 100. Each of the resistance circuits 120 includes a carbon resistor 121 and conductive portion 122 arranged straightly at a distance therebetween. The contact 90 includes a pair of contacting portions 91 and 91 arranged straightly so that they come into contact with the carbon resistor 121 and the conductive portion 122. The carbon resistor 121 and the conductive portion 122 are brought into conduction to constitute the volume.

Next, a function of the multi-directional input apparatus according to the embodiment of the present invention will be explained.

If the operating member 30 is inclined toward the long hole 43B of the lower turning member 40B, the upper turning member 40A is turned. With this movement, the volume portion 20A is operated, and a resistance value corresponding to the operation amount is obtained. That is, in the volume portion 20A, the gear 44A is turned by the turning movement of the turning member 40A, thereby moving the straight-ahead slider 80, the contact 90 slides on the corresponding resistance circuit 120, and a resistance value corresponding to the operation amount is obtained.

If the operating member 30 is inclined toward the long hole 44A of the upper turning member 40A, the lower turning member 40B is turned. With this movement, the volume portion 20B is operated, and a resistance value corresponding to the operation amount is obtained. That is, in the volume portion 20B, the gear 44B is turned by the turning movement of the turning member 40B, thereby moving the straight-ahead slider 80, the contact 90 slides on the corresponding resistance circuit 120, and a resistance value corresponding to the operation amount is obtained.

The operating member 30 is operated in an arbitrary direction by a combination of the above movements, and a signal in accordance with the operation direction and amount is input to electronic equipment which uses the multi-directional input apparatus.

If the operating member 30 is pushed down in the axial direction, the pushdown switch provided below the operating member 30 is operated. That is, if the operating member 30 is pushed down, the switch body 110 on the board 100 is pushed down through the key top 70, the domical movable contact piece 112 is deformed downward and brought into contact with the second contact 111*b* of the stationary contact 111, thereby bringing the first contact 111*a* and the second contact 111*b* into conduction.

The pushdown switch comprises the key top 70 in the case 10, and the switch body 110 provided on the board 100. That is, only the key top 70 of the pushdown switch is provided in the case 10, and the switch body 110 is provided on the board 100 below the case 10. With this structure, when the multi-directional input apparatus is mounted on the board 100, it is unnecessary to solder the pushdown switch to the board 100.

Further, the switch body 110 comprises three parts, i.e., the stationary contact 111, the movable contact piece 112 and the resin sheet 113. Therefore, the number of parts constituting the pushdown switch can largely be reduced as compared with the number of parts (several) constituting the conventional pushdown switch unit and thus, the cost can be reduced.

The volume portions 20A and 20B comprise the slider accommodating portions 16 and 16 provided on the two perpendicular side surfaces of the case 10, the fan-like gears 44A and 44B provided on one ends of the turning members 40A and 40B, and the straight-ahead sliders 80 and 80 accommodated in the slider accommodating portions 16 and 16, and the contacts 90 and 80 mounted to the lower surfaces of the straight-ahead sliders 80 and 80. Among these constituent parts, the slider accommodating portions 16 and 16 and the gears 44A and 44B are integrally formed together with the existing constituent elements of the multi-directional input apparatus. Therefore, the parts required for constitute the volume portions 20A and 20B are two parts, i.e., the straight-ahead sliders 80 and 80 and the contacts 90 and 90.

Therefore, not only the number of parts of the pushdown switch, but also the number of signal output means can largely reduced, and the cost can also be reduced.

Further, like the pushdown switch, when the volume sections 20A and 20B as the signal output means are mounted, it is unnecessary to solder the volume sections to the resistance circuits 120 and 120 on the board 100. That is, when the multi-directional input apparatus is mounted, no soldering operation is required. Therefore, the assembling cost of electronic equipment which uses the multi-directional input apparatus can largely be reduced.

As explained above, according to the multi-directional input apparatus of the present invention, the pushdown switch comprises a combination of the key top which is vertically movably provided below the operating member such as to pass through the bottom plate of the case, and the switch body which is located below the key top and mounted on the board, and which is operated when the operating member is pushed down and the key top is moved down. Therefore, it is unnecessary to solder the pushdown switch to the board at the time of mounting operation. Thus, it is possible to reduce the assembling cost of equipment which uses the multi-directional input apparatus, and to reduce the manufacturing costs of the multi-directional input apparatus.

According to another multi-directional input apparatus of the invention, since the switch body comprises a combination of the stationary contact formed on the board and the domical movable contact piece secured on the stationary contact, the number of parts constituting the switch body can largely be reduced. For this reason also, it is possible to reduce the manufacturing cost of the equipment which uses the multi-directional input apparatus.

According to another multi-directional input apparatus of the invention, the movable contact piece is secured on the stationary contact by pasting the resin sheet on the board from above the movable contact piece. Therefore, the number of manufacturing steps of the switch body can be reduced. For this reason also, it is possible to reduce the manufacturing cost of the equipment which uses the multi-directional input apparatus.

According to another multi-directional input apparatus of the invention, as the signal output means for outputting signal corresponding to the turning angle of the turning member, gears are mounted to one ends of the set of upper and lower turning members in the case secured on the board, the straight-ahead sliders capable of moving along the two side surfaces of the case and the board are mounted below the gears, teeth meshing with the gears are provided on the upper surfaces of the straight-ahead sliders, and the contacts which can slide to come into contact with the resistance circuits to constitute the volumes together with the resistance circuits are mounted on the lower surfaces of the straight-ahead sliders, thereby integrally forming the signal output means with the apparatus. Therefore, it is possible to largely reduce the number of parts of the signal output means, and to further reduce the manufacturing costs of the apparatus. Further, it is unnecessary to solder the signal output means to the board, and it is possible to reduce the assembling cost of the equipment which uses the multi-directional input apparatus.

INDUSTRIAL APPLICABILITY

The present invention can be utilized as an input device of a personal computer, a game machine and the like.

What is claimed is:

1. A multi-directional input apparatus comprising a case secured on a board; a set of upper and lower turning members supported in said case such that said turning members can turn into two intersecting directions and each having a long hole extending in a direction perpendicular to said turning direction; an operating member which can be pushed down and which passes through each of said long holes of said set of upper and lower turning members, said operating member turning each of said turning members when said operating member is operated in arbitrary direction therearound; a holding mechanism for resiliently holding said operating member or said turning members at a neutral position; a set of signal output means for outputting signal corresponding to a turning angle of each of said turning members; and a pushdown switch which is switched when said operating member is pushed down; wherein said pushdown switch comprises a combination of a key top which is vertically movably provided below said operating member such as to pass through a bottom plate of said case, and a switch body which is located below said key top and mounted on said board, and which is operated when said operating member is pushed down and said key top is moved down.

2. The multi-directional input apparatus according to claim 1, wherein said switch body comprises a combination of a stationary contact formed on said board and a domical movable contact piece which can be resiliently deformed and secured on said stationary contact.

3. The multi-directional input apparatus according to claim 2, wherein said movable contact piece is secured on said stationary contact by pasting a resin sheet on said board from above said movable contact piece.

4. The multi-directional input apparatus according to any one of claims 1 to 3, wherein said signal output means is constituted such that gears are mounted to one ends of said set of upper and lower turning members, straight-ahead sliders capable of moving along two side surfaces of said case and said board are mounted below said gears, teeth meshing with said gears are provided on upper surfaces of said straight-ahead sliders, and said contacts which can slide to come into contact with resistance circuits to constitute volumes together with said resistance circuits are mounted on lower surfaces of said straight-ahead sliders.

* * * * *